US006180164B1

(12) United States Patent
Ellis et al.

(10) Patent No.: US 6,180,164 B1
(45) Date of Patent: Jan. 30, 2001

(54) METHOD OF FORMING RUTHENIUM-BASED THICK-FILM RESISTORS

(75) Inventors: Marion Edmond Ellis, Kokomo; Philip Harbaugh Bowles; Washington Morris Mobley, both of Carmel, all of IN (US)

(73) Assignee: Delco Electronics Corporation, Kokomo, IN (US)

( * ) Notice: Under 35 U.S.C. 154(b), the term of this patent shall be extended for 0 days.

(21) Appl. No.: 09/178,758

(22) Filed: Oct. 26, 1998

(51) Int. Cl.[7] ..... B05D 5/12; H01C 17/00

(52) U.S. Cl. ..... 427/101; 427/103; 427/126.5; 427/380; 29/610.1; 29/620

(58) Field of Search ..... 427/101, 103, 427/123, 126.5, 379, 380; 29/610.1, 620

(56) References Cited

U.S. PATENT DOCUMENTS

| | | | | |
|---|---|---|---|---|
| 4,316,942 | * | 2/1982 | Kuo | 428/432 |
| 4,503,090 | * | 3/1985 | Brown et al. | 427/96 |
| 4,949,065 | * | 8/1990 | Watanabe et al. | 338/308 |
| 5,302,412 | * | 4/1994 | Tamhankar et al. | 427/102 |
| 5,463,367 | * | 10/1995 | Ellis | 338/308 |

OTHER PUBLICATIONS

Kuo, Thick Film Copper Conductor and Ruthenium–based Resistor System for Resistor Circuits, Int'l Journal for Hybrid Microelectronics, Int'l Microelectronics Symposium (1983) p. 54–59.

Steinberg et al., Nitrogen Fireable Hybrid Thick Film Inks, Int'l Society for Hybrid Microelectronics, Int'l Microelectronics Sumposium, Seattle (1988) p. 392–397.

Kuo, Nitrogen Fireable Tin Oxide Thick Film Resistor System, Int'l Society for Hybrid Microelectronics, Int'l Symposium on Microelectronics, Baltimore (1989) p. 150–167.

* cited by examiner

*Primary Examiner*—Brian K. Talbot
(74) *Attorney, Agent, or Firm*—Jimmy L. Funke

(57) ABSTRACT

A method for forming a ruthenium-based thick-film resistor having copper terminations, in which the thick-film resistor is fired in a non-oxidizing atmosphere so as not to oxidize the copper terminations yet without reducing the thick-film resistor to metallic ruthenium. A ruthenium-based thick-film resistor ink having a matrix material and an organic vehicle is deposited on a copper layer that will form the terminations for the thick-film resistor formed by firing the ink. The organic vehicle of the ink is then burned out at a temperature of less than 350° C. in an oxidizing atmosphere, such as air. Thereafter, the ink is fired in a non-oxidizing atmosphere (e.g., nitrogen) at a temperature sufficient to sinter the matrix material and yield a ruthenium-based thick-film resistor with copper terminations formed by the copper layer.

20 Claims, 2 Drawing Sheets

METHOD OF FORMING RUTHENIUM-BASED THICK-FILM RESISTORS

FIELD OF THE INVENTION

The present invention generally relates to thick-film resistors used in hybrid electronic circuits, and to the processing of such resistors. More particularly, this invention relates to a method for forming a ruthenium-based thick-film resistor in combination with copper conductors that form terminations for the resistor.

BACKGROUND OF THE INVENTION

Thick-film resistors are employed in hybrid electronic circuits to provide a wide range of resistor values. Such resistors are printed on ceramic substrates using thick-film pastes, or inks, which are typically composed of an organic vehicle, a glass frit composition, and an electrically-conductive material. After printing, thick-film inks are typically dried and then sintered, or fired, to convert the ink into a solid film that adheres to the ceramic substrate. During firing, the ink is heated at a rate that is sufficiently slow to allow the organic vehicle of the ink to burn off, which generally begins at about 345° C. and is completed at about 400° C. to 450° C. with commercially available ink compositions. Peak firing temperatures are typically in the range of about 850° C. to 950° C. Both physical and chemical changes occur within the thick film during sintering, by which the conduction network or microstructure of the resistor is formed. Various additives may be used to achieve specific desired resistivity, stability and temperature characteristics.

Ruthenium-based resistors are widely recognized in the art for their reliability and stable resistance values. A limitation to ruthenium-based thick-film resistors is that their inks must be fired in oxidizing atmospheres in order to prevent the ruthenium compound, usually ruthenium dioxide ($RuO_2$), from being reduced to metallic ruthenium. It has been reported that reduction of ruthenium dioxide begins at about 350° C. in a nitrogen atmosphere.

Thick-film conductors for hybrid circuits are also formed using thick-film inks, with thick-film copper conductors being widely used in view of their low bulk resistivity (sheet resistance about 3 milliohms per square). Thick-film copper inks are fired in a nitrogen atmosphere to avoid the metallic copper from being oxidized into copper oxide, which would prevent the resulting conductor from having high conductivity (low resistivity) and adequate solderability.

From the above, one can see that thick-film ruthenium-based resistors and copper conductors have conflicting processing requirements —ruthenium-based resistors require an oxidizing firing environment, while copper conductors require a non-oxidizing environment. Various solutions have been proposed to overcome this limitation and permit the simultaneous use of ruthenium-based resistors and copper conductors on the same hybrid circuit board. One solution is a process taught by Kuo, *Thick Film Copper Conductor and Ruthenium-Based Resistor System for Resistor Circuits,* The International Journal for Hybrid Microelectronics, International Microelectronics Symposium (1983), that requires a first firing in air at 850° C. to 950° C. for the thick-film copper conductor, a second firing in air for the ruthenium-based resistor, and then firing at about 260° C. to 400° C. in a hydrogen-nitrogen atmosphere to reduce the oxidized copper produced when the copper was fired in air. The copper conductors and ruthenium-based resistors produced by this process are disclosed as having desirable electrical properties.

Another process-related solution is to print and then fire a ruthenium-based thick-film ink in air at 850° C. to 950° C., followed by printing and firing a thick- film copper conductor ink at 600° C. in nitrogen. A significant drawback to this process is that the resulting resistors cannot be measured for resistance and temperature-related properties like TCR (temperature coefficient of resistance) until after the conductor had been printed and fired, resulting in scrappage that could be otherwise avoided.

Other suggested solutions have required composition changes to the ruthenium-based thick-film ink. One such solution taught by Hankey et al., *Introduction of a Novel Copper Compatible Nitrogen Firing Resistor System,* IMC Proceedings (1986), p. 98–102, entails incorporating ruthenium dioxide in a perovskite structure to provide stability during firing in nitrogen. However, doing so significantly complicates the formulation process for obtaining a thick-film resistor of desired resistance value. Another alternative is to forego the advantages of ruthenium-based thick-film resistors, and instead employ base metal thick-film inks that can be fired in a nitrogen atmosphere so as to be compatible with copper conductors. Base metal (non-noble metal) base resistors are not as stable as ruthenium-based resistors, and generally require glass passivation to promote their stability.

From the above, it can be seen that present practices involving the processing of thick-film ruthenium-based resistors with copper conductors are generally complicated. Again, the incompatibility arises from the conventional wisdom that thick-film ruthenium-based resistors must be fired in an atmosphere that will adversely oxidize copper conductors. From the standpoint of cost and stability, it would be highly desirable if a less complicated process was available that enabled the production of thick-film ruthenium-based resistors with copper conductors.

SUMMARY OF THE INVENTION

It is an object of this invention to provide a method for forming a ruthenium-based thick-film resistor having copper terminations, in which the thick-film resistor is fired in a non-oxidizing atmosphere so as not to oxidize the copper terminations yet without reducing the thick-film resistor to metallic ruthenium.

According to the present invention, a ruthenium-based thick-film resistor ink having a matrix material and an organic vehicle is deposited on a copper conductor that will form the terminations for the thick-film resistor formed by firing the ink. The organic vehicle of the ink is then burned out at a temperature of less than 350° C. in an oxidizing atmosphere, such as air. Thereafter, the ink is fired in a non-oxidizing atmosphere (e.g., nitrogen) at a temperature sufficient to sinter the matrix material and yield a ruthenium-based thick-film resistor with copper terminations formed by the copper layer.

From the above, it can be seen that the process of this invention is contrary to conventional wisdom that prohibits firing of a ruthenium-based resistor ink in anything other than an oxidizing atmosphere. The invention is also contrary to the prevailing opinion that the burnout of the organic portion of a thick-film ink must be done in the same atmosphere in which the ink is fired. Instead, it has been unexpectedly determined that a ruthenium-based thick-film ink can be fired in nitrogen or another non-oxidizing atmosphere if its organic constituents are removed prior to the ink being subjected to temperatures above about 350° C. At temperatures below 350° C., and particularly below 300° C., copper undergoes limited oxidation. By formulating the ruthenium-based thick-film ink to contain an organic vehicle with a lower burnout temperature than conventionally used, the organic vehicle can be removed in air with minimal detrimental effect on the copper terminations for the resistor.

Accordingly, a significant advantage of this invention is that a ruthenium-based thick-film resistor can be processed on a substrate with copper without complicated formulation and firing steps. As such, this invention makes possible an extremely stable thick-film resistor that is compatible with copper terminations, and therefore can benefit from the performance advantages associated with copper terminations.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
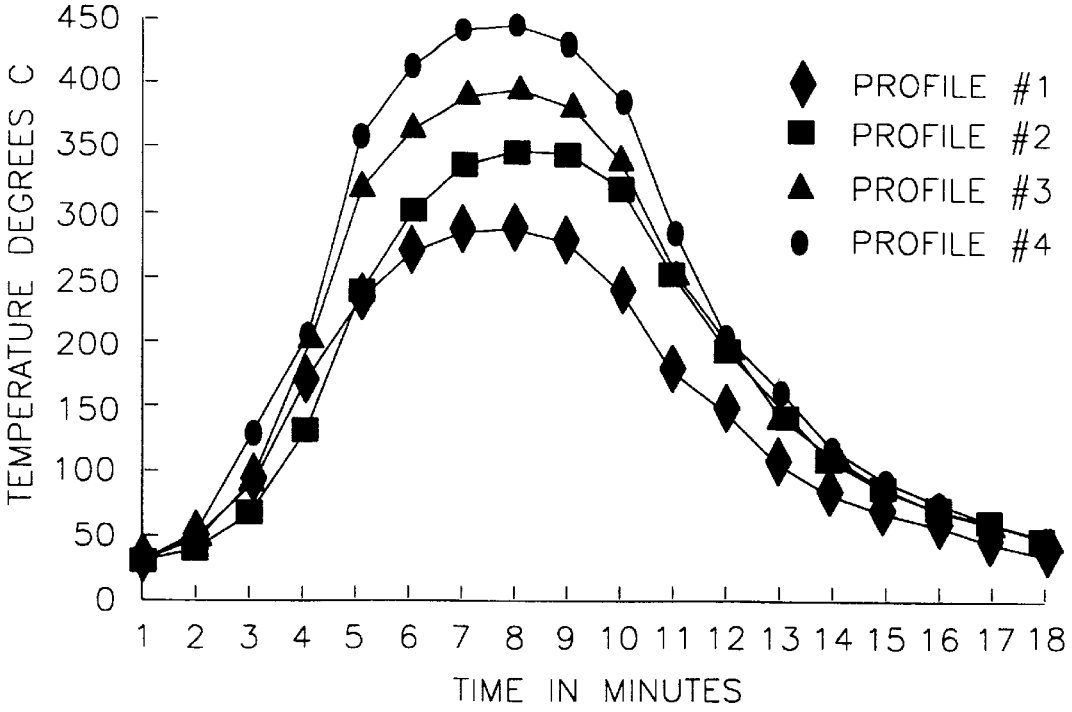
FIG. 1 is a graph representing heating profiles used to evaluate organic burnout in a prior art ruthenium-based thick-film ink.

The present invention provides a method for forming ruthenium-based thick-film resistors and copper conductors on hybrid electronic circuits, and particularly a process by which ruthenium-based thick-film resistors can be fired on a copper conductor in a non-oxidizing atmosphere (e.g., nitrogen) without being reduced to metallic ruthenium. Those skilled in the art will appreciate that numerous physical and compositional configurations and variations are possible for such resistors and their conductors, and such configurations and variations are within the scope of this invention.

Various ruthenium-based resistor ink compositions, including inks such as 1650, 6221, 6231 and 6241 commercially available from DuPont Electronic Materials, are suitable for forming thick-film resistors of this invention. These ink compositions generally contain a ruthenium-based conductive fraction such as ruthenium dioxide and/or a pyrachlor of ruthenium such as bismuth ruthenate or lead ruthenate, a glass frit portion that, upon firing, bonds together to form an inorganic matrix for the resistor, and a vehicle for printing. A preferred ink composition contains ruthenium dioxide as the conductive material, an organic vehicle that will burn cleanly and completely at temperatures below 350° C., and a highly stable lead-alumina-borosilicate glass frit system taught by U.S. Pat. No. 5,463,367 to Ellis, commonly assigned with this application and whose contents are incorporated herein by reference. A suitable organic vehicle capable of burning off in air at a sufficiently low temperature is a terpineol/acrylic-based material that is commercially-available under the name CERDEC 1562 from Cerdec Corporation Drakenfeld Products, though it is foreseeable that other organic materials could be used. CERDEC 1562 contains, by volume, about 60 to 80% terpineol, about 2 to 5% ester alcohol and 5 to 38% acrylic resin. The glass frit system taught by Ellis contains litharge (PbO), boric acid ($H_3BO_3$), silicon dioxide ($SiO_2$) and alumina ($Al_2O_3$) and one or more of titanium oxide ($TiO_2$), cupric oxide (CuO), and manganese oxide ($MnO_2$) or manganese carbonate ($MnCO_3$) as a source for manganese oxide. Thick-film resistors formulated with the glass frit system taught by Ellis exhibit laser trim stability and have TCR values that can be shifted as required by small additions of titania, cupric oxide and manganese oxide contained in the frit system. Notably, use by the present invention of a lead-containing glass frit system is contrary to the prior art, which has taught that glass frit systems containing lead are not suitable for nitrogen-fireable resistors.

The copper conductors employed by the invention can be formed by essentially any known process, such as a printed copper-based ink composition (about 3 milliohms/square) or copper foil (about 1.7 micro-ohms·cm). Suitable thick-film conductor materials include the 5800 series inks from EMCA-REMEX, the 7229 and 7230 inks from Heraeus Inc. (Cermalloy Division), and all 9900 series, QP series and QS series inks from DuPont. Importantly, the copper conductors used in combination with the ruthenium-based resistor of this invention are fired in a non-oxidizing atmosphere, such as nitrogen, in order to avoid being oxidized into copper oxide and losing its high conductivity and low resistivity. According to the prior art, ruthenium-based resistor materials are reduced to metallic ruthenium at temperatures above about 350° C. if not processed in an oxygen atmosphere, which would make the use of the preferred ruthenium dioxide impractical. However, in accordance with this invention, a ruthenium-based resistor ink can be fired on a copper conductor in a nitrogen atmosphere if the organic vehicle in the ink is first burned off at a temperature below 350° C. in an oxygen-containing atmosphere. At such temperatures, little oxidation of the copper conductors occurs. After the organic vehicle is burned off, firing can be performed in a nitrogen or other non-oxidizing atmosphere and heated at a temperature sufficient to sinter the inorganic portion of the resistor, e.g., about 850° C. to 900° C. Surprisingly, and contrary to prior art teachings, the ruthenium compound of the thick-film resistor ink is not reduced to metallic ruthenium in the nitrogen atmosphere. The result is a highly stable nitrogen-fired ruthenium-based resistor on unoxidized copper terminations.

During investigations leading to this invention, the DuPont ruthenium-based thick-film ink 6241 was screen printed and dried using standard procedures onto four copper foils. This ink generally contains ruthenium dioxide as the conductive fraction, an inorganic matrix material, and a heavy organic vehicle. The foils were then subjected to four burnout profiles depicted in FIG. 1, all performed in air, with peak temperatures being: 295° C. for Profile #1; 345° C. for Profile #2; 395° C. for Profile #3; and 445° C. for Profile #4. Following burnout, the foils were visually examined. Results showed that the organic vehicle began to burn out above 295° C. and around 345° C. The inks generally began to lose their fine definition, and oxidation of the copper foils was in progress at 345° C. At 395° C., it appeared that the organic vehicle was completely removed, but that the copper foils had an oxide film that was removable by abrasion. A thicker oxide film was observed for foils subjected to the 445° C. treatment.

Figure 2:
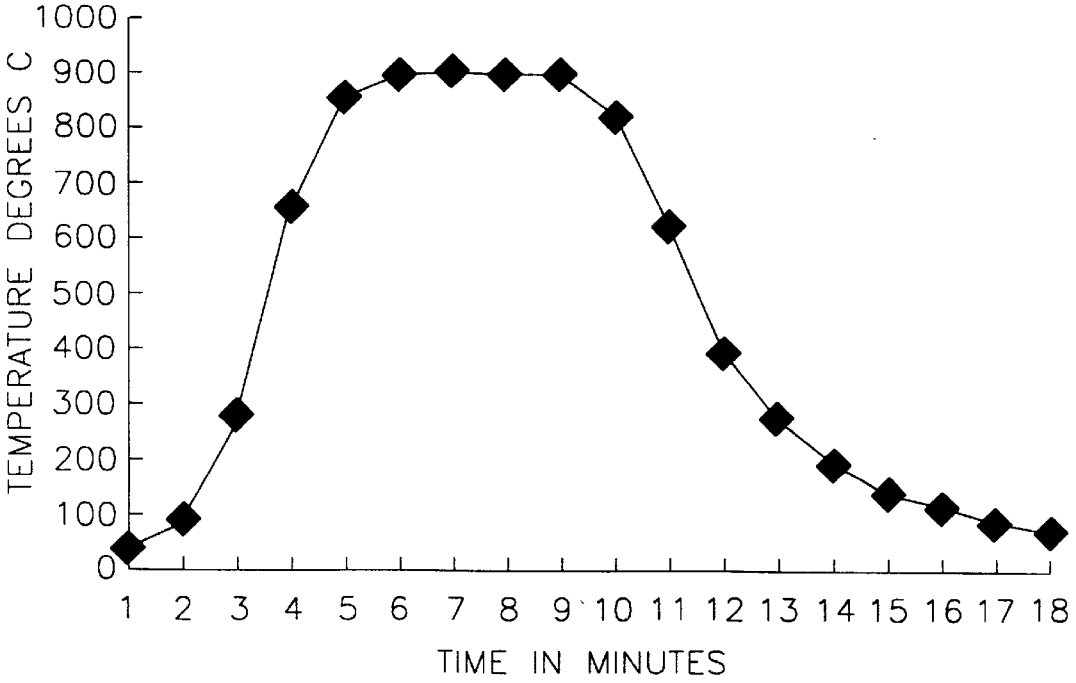
FIG. 2 is a graph representing a heating profile used to fire a ruthenium-based thick-film ink in accordance with this invention.

After examination, the foils were fired at 905° C. in a nitrogen atmosphere having an oxygen content of about 5 to 10 parts per million (ppm) according to the time and temperature profile shown in FIG. 2. Afterwards, the specimens were again visually inspected. The specimens originally subjected to burnout Profile #1 had unoxidized copper foils but the resistor was completely reduced to metal. The remaining specimens (burnout Profiles #2, #3 and #4) were not reduced to metal though their copper foils were excessively oxidized. From the results of using burnout Profiles #2, #3 and #4, it was concluded that copper will oxidize at the temperatures required to achieve complete organic burnout of conventional ruthenium-based thick-film inks such as DuPont 6241, though that a ruthenium-based ink is not reduced to metal if the organic vehicle is completely burned out before the ink is fired in nitrogen.

Additional testing was then performed to evaluate the performance of commercially-available ruthenium-based thick-film inks and base metal thick-film inks on 96% alumina ceramic when initially fired in a nitrogen atmosphere according to burnout Profile #2 (345° C.). One group of specimens compared four ruthenium dioxide-based thick-film inks terminated with a silver-palladium (AgPd) conductor and fired in either air or nitrogen following burnout. The thick-film inks were DuPont 6221, 6231, 6241 and 1650, while the AgPd conductors were formed with DuPont 7484 thick-film ink. A second group of specimens compared AgPd-terminated resistors formed from 6231 and 6241 inks with two commercially-available base metal resistors that are designed for firing in nitrogen so as to be compatible with copper conductors. The base metal inks were R8533D and R8543.3D, available from Heraeus (Cermalloy Division). The inks of the second group were terminated with Heraeus C7230 copper conductor ink. After laser trimming to 1.5 times their average resistance value, all specimens were subjected to humidity testing at 150° C. and 85/85 humidity (85% relative humidity at 85° C.) for 504 hours, and thermal cycled between −50° C. and +150° C. for 504 cycles. The results for the first and second groups of specimens are summarized in Tables I and II, respectively.

TABLE I

| | 6221 | | 6231 | | 6241 | | 1650 | |
|---|---|---|---|---|---|---|---|---|
| | Air | $N_2$ | Air | $N_2$ | Air | $N_2$ | Air | $N_2$ |
| Ω/Square | 72 | 80 | 946 | 1.2K | 11K | 9.7K | 110K | 38K |
| CV % | 7 | 6 | 1.1 | 19 | 5.3 | 37 | 3.5 | 40 |
| HTCR | 73 | 116 | 48 | −95 | 50 | −63 | 76 | 306 |
| CTCR | 27 | 82 | 27 | 82 | −3 | −181 | 20 | 333 |
| Hum. % | 0.2 | 0.2 | 0.1 | 0.2 | 0.1 | 0.3 | 0.1 | 0.1 |
| Therm. % | 0.2 | 0.2 | 0.3 | 0.3 | 0.3 | 0.3 | 0.2 | 0.2 |

TABLE II

| | R8533D | R8543.3D | 6231 | 6241 |
|---|---|---|---|---|
| Ω/Square | 633 | 42.7K | 621 | 4.4K |
| CV % | 9.4 | 11 | 16.4 | 22.3 |
| HTCR | 143 | −68 | −12 | −219 |
| CTCR | 112 | −134 | −103 | −343 |
| Hum. % | 18.3 | 12.2 | 0.1 | 0.2 |
| Therm. % | 14.0 | 60.8 | 0.2 | 0.2 |

NOTES:
CV % - Coefficient of Variation.
HTCR - TCR value at 25° C. to 125° C. (ppm/° C.).
CTCR - TCR value at 25° C. to −55° C. (ppm/° C.).
Hum. % - % Change in resistance, humidity testing.
Therm. % - % Change in resistance, thermal testing.

The above results show that the average sheet resistance of conventional ruthenium-based resistors terminated with AgPd conductors and fired in nitrogen tracked the air-fired values for these same resistors fairly well up to about 10K ohms/square. However, the coefficients of variation for the nitrogen-fired resistors were very high. Relative to stability, the nitrogen-fired ruthenium-based AgPd-terminated resistors appeared to exhibit the stability known for air-fired ruthenium-based resistors. The stability of the base metal resistors appeared to exhibit the degree of stability typical for such resistors when not protected by a glass passivation coat. Overall, the data showed that nitrogen-fired ruthenium-based resistors can be expected to be as stable as air-fired ruthenium-based resistors if the organic vehicle is first burned out in air.

Together, the investigations discussed above showed the desirability of a ruthenium-based thick-film resistor ink whose organic vehicle can be burned out completely at a temperature of below 350° C., and preferably below 300° C., so as not to oxidize the copper terminations. As a result, a fmal experiment was conducted with ruthenium-based thick-film inks formulated as summarized in Table IV with an organic media capable of burning out at temperatures below that of organic vehicles typically used in commercial thick-film resistor inks. The organic media used in this experiment was the CERDEC 1562 material discussed above. The inorganic matrix materials for the inks were one of the two glass frit mixtures summarized in Table III below and formulated in accordance with U.S. Pat. No. 5,463,367 to Ellis.

TABLE III

| Constituent | Frit #1 | Frit #2 |
|---|---|---|
| PbO | 52.8 wt. % | 53.3 wt. % |
| $H_3BO_3$ | 15.0 | 15.1 |
| $SiO_2$ | 19.2 | 19.4 |
| $Al_2O_3$ | 8.0 | 8.2 |
| $TiO_2$ | 0.5 | 1.0 |
| CuO | 0.5 | 3.0 |
| $MnCO_3$ | 4.0 | 0.0 |

The ruthenium compound was a ruthenium dioxide powder having a bulk surface area of 27 $m^2$/gram.

TABLE IV

| Constituent | Ink #1 | Ink #2 |
|---|---|---|
| $RuO_2$ | 22 wt. % | 14 wt. % |
| Glass Frit #1 | 46 | — |
| Glass Frit #2 | — | 54 |
| Organic Vehicle | 32 | 32 |

The above compositions were mixed and roll-milled to smooth pastes according to standard procedures, and then screen printed onto 96% alumina ceramic previously separated into two groups. One group had been prepared with DuPont 7484 AgPd conductor ink that was fired in air at a peak temperature of about 850° C. The C7230 copper thick-film ink was printed on the second group of substrates, and then fired in nitrogen according to the profile shown in FIG. 2. The #1 and #2 resistor inks of Table IV were then printed and dried on the AgPd and copper conductors according to standard procedure. The inks printed on the AgPd conductors were fired in air at about 850° C. while, to avoid copper oxidation, the inks printed on the copper conductors were subject to burnout at 295° C. (Profile #1 of FIG. 1) and then fired in nitrogen according to the profile of FIG. 2. After firing, the sheet resistance of each resulting resistor was measured, the data statistically analyzed, and an algorithm was defined for predicting sheet resistance based on ink composition and firing conditions. The results are summarized in Table V.

TABLE V

| | Atmosphere | Ohms/Square Measured | Ohms/Square Predicted |
|---|---|---|---|
| Ink #1 | Air | 48 | 22 |
| Ink #2 | Air | 500 | 797 |

TABLE V-continued

| | Atmosphere | Ohms/Square Measured | Ohms/Square Predicted |
|---|---|---|---|
| Ink #1 | Nitrogen | 174 | 217 |
| Ink #2 | Nitrogen | 11100 | 16628 |

The algorithm was used to define compositions for decade-value end-member inks for nitrogen-fired resistors in accordance with this invention. Specifically, compositions were defined for 73 ohms/square, 1105 ohms/square and 9668 ohms/square to cover the sheet resistance range of 100 ohms/square to 10K ohms/square. The compositions are summarized in Table VI.

TABLE VI

| Constituent | Ink #1 | Ink #2 | Ink #3 |
|---|---|---|---|
| $RuO_2$ | 24 wt. % | 19 wt. % | 15 wt. % |
| Glass Frit #1 | 44 | — | — |
| Glass Frit #2 | — | 49 | 53 |
| Organic Vehicle | 32 | 32 | 32 |

These compositions were mixed and roll-milled to smooth pastes according to standard procedure, and then printed onto 96% alumina ceramic prepared with C7230 copper conductors. To avoid copper oxidation, the printed inks were subjected to a 295° C. burnout (Profile #1 of FIG. 1), and then fired in nitrogen according to the profile shown in FIG. 2, after which sheet resistance and TCR were measured. The data are summarized in Table VII.

TABLE VII

| Ink | Ohms/square | CTCR | HTCR |
|---|---|---|---|
| #3 | 127 | 544 | 535 |
| #4 | 2023 | −69 | −106 |
| #5 | 8373 | −275 | −305 |

NOTES:
CTCR - TCR value at 25° C. to −55° C. (ppm/° C.)
HTCR - TCR value at 25° C. to 125° C. (ppm/° C.)

Figure 3:
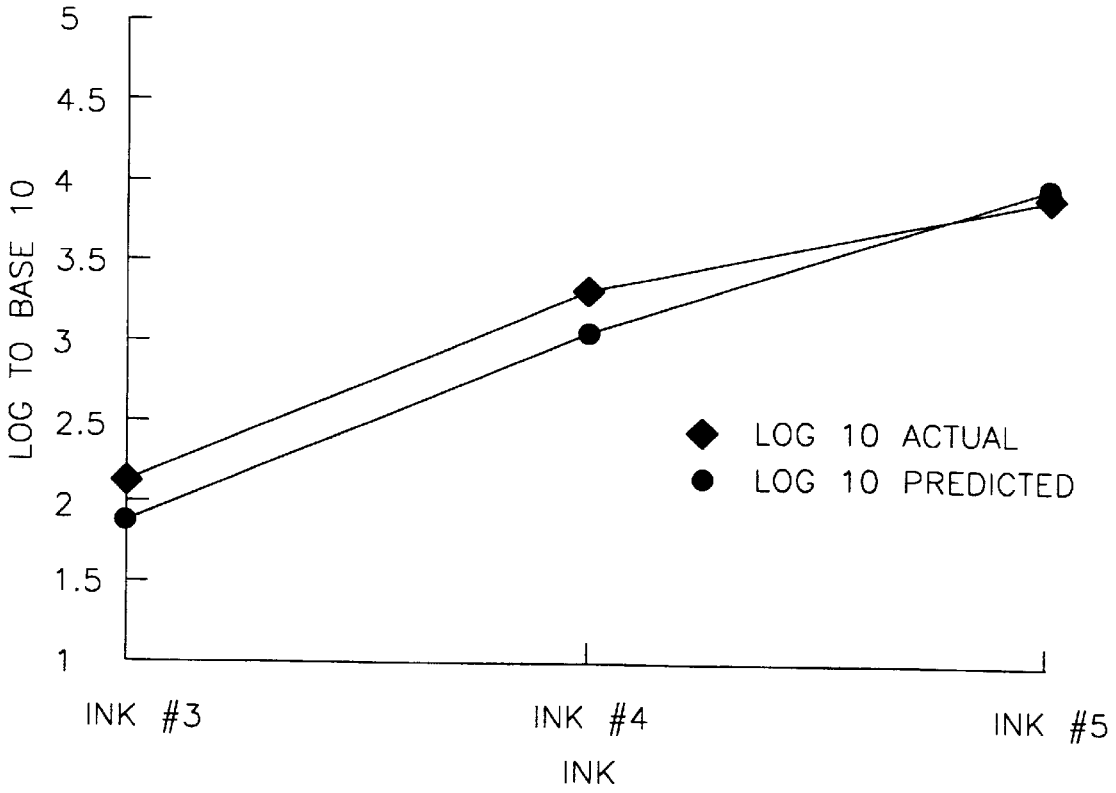
FIG. 3 is a graph showing actual versus predicted sheet resistances of ruthenium-based thick-film resistors formulated and processed in accordance with this invention.

As shown in FIG. 3, the actual sheet resistance data obtained for these inks compared favorably to the sheet resistance values predicted for them, indicating that the performance of ruthenium-based resistors formulated for firing in a nitrogen atmosphere is predictable and controllable. Control of TCR values to ±100 ppm/° C. can be achieved by applying the teachings of U.S. Pat. No. 5,463,367 to Ellis with further additions of titanium oxide, cupric oxide, manganese oxide, and/or manganese carbonate to the glass frit mixture.

While our invention has been described in terms of particular embodiments, it is apparent that other forms could be adopted by one skilled in the art. Accordingly, the scope of our invention is to be limited only by the following claims.

What is claimed is:

1. A method of forming a ruthenium-based thick-film resistor with copper terminations, the method comprising the steps of:

depositing a ruthenium-based thick-film ink on a copper-based conductive layer, the thick-film ink containing a matrix material and an organic vehicle;

heating the thick-film ink in an oxidizing atmosphere to a temperature of less than 350° C. to remove the organic vehicle; and then further heating the thick-film ink in a non-oxidizing atmosphere to a temperature sufficient to sinter the matrix material and yield a ruthenium-based thick-film resistor with copper terminations formed by the copper-based conductive layer.

2. A method as recited in claim 1, wherein the organic vehicle is a terpineol/acrylic-based material.

3. A method as recited in claim 1, wherein the heating step performed in the oxidizing atmosphere entails a peak temperature of less than 300° C.

4. A method as recited in claim 1, wherein the heating step performed in the non-oxidizing atmosphere entails a peak temperature of about 850° C. to about 950° C.

5. A method as recited in claim 1, wherein the non-oxidizing atmosphere is nitrogen.

6. A method as recited in claim 1, wherein the oxidizing atmosphere is air.

7. A method as recited in claim 1, further comprising the step of forming the copper-based conductive layer by depositing a copper-based electrically-conductive ink on a ceramic substrate, and then firing the electrically-conductive ink in a non-oxidizing atmosphere to a temperature sufficient to yield the copper-based conductive layer.

8. A method as recited in claim 1, wherein the thick-film ink further contains ruthenium dioxide.

9. A method as recited in claim 1, wherein the matrix material comprises a mixture of glass frit materials.

10. A method as recited in claim 1, wherein the matrix material comprises litharge, boric acid, silicon dioxide and aluminum oxide.

11. A method as recited in claim 10, wherein the matrix material further comprises at least one material selected from the group consisting of titanium oxide, cupric oxide, manganese oxide, and manganese carbonate.

12. A method for forming a ruthenium-based thick-film resistor with copper terminations, the method comprising the steps of:

providing a substrate of a hybrid electronic circuit;

depositing a copper-based electrically-conductive ink on the substrate so as to form a pre- fired conductive thick film;

heating the copper-based electrically-conductive ink in a non-oxidizing atmosphere to a temperature sufficient to yield a pair of copper conductors;

depositing an electrically-resistive ink on the copper conductors and the substrate so as to form a pre-fired resistive thick film, the electrically-resistive ink containing ruthenium dioxide, an inorganic matrix material and an organic vehicle;

heating the pre-fired resistive thick film in an oxidizing atmosphere to a temperature of less than 350° C. to remove the organic vehicle from the pre-fired resistive thick-film; and then further heating the pre-fired resistive thick film in a nitrogen-containing atmosphere to a temperature sufficient to sinter the inorganic matrix material of the pre-fired resistive thick film and yield a ruthenium-based thick-film resistor with copper terminations formed by the copper conductors.

13. A method as recited in claim 12, wherein the organic vehicle is a terpineol/acrylic-based material consisting essentially of, by volume, about 60 to 80% terpineol, about 2 to 5% ester alcohol and 5 to 38% acrylic resin.

14. A method as recited in claim 12, wherein the heating step performed in the oxidizing atmosphere entails a peak temperature of less than 300° C.

15. A method as recited in claim 12, wherein the heating step performed in the non-oxidizing atmosphere and the heating step performed in the nitrogen-containing atmosphere entails a peak temperature of about 850° C. to about 950° C.

16. A method as recited in claim 12, wherein the non-oxidizing atmosphere is nitrogen.

17. A method as recited in claim 12, wherein the oxidizing atmosphere is air.

18. A method as recited in claim 12, wherein the matrix material comprises a mixture of glass frit materials.

19. A method as recited in claim 12, wherein the matrix material comprises litharge, boric acid, silicon dioxide and aluminum oxide.

20. A method as recited in claim 19, wherein the matrix material further comprises at least one material selected from the group consisting of titanium oxide, cupric oxide, manganese oxide, and manganese carbonate.

* * * * *